US006247324B1

(12) United States Patent
Hsu

(10) Patent No.: US 6,247,324 B1
(45) Date of Patent: Jun. 19, 2001

(54) AIR CONDITIONING APPARATUS WITH A WATER PUMP

(76) Inventor: Chien-Chih Hsu, No. 711, Sec. 2, Ming-Sung Rd., Ming-Chien, Hsiang, Nan-Tou Hsien (TW)

( * ) Notice: Subject to any disclaimer, the term of this patent is extended or adjusted under 35 U.S.C. 154(b) by 0 days.

(21) Appl. No.: 09/520,088

(22) Filed: Mar. 7, 2000

(51) Int. Cl.[7] ..... F25D 21/14
(52) U.S. Cl. ..... 62/285; 62/434; 62/288
(58) Field of Search ..... 62/434, 205, 288

(56) References Cited

U.S. PATENT DOCUMENTS

| | | | | |
|---|---|---|---|---|
| 2,779,171 | * | 1/1957 | Lindenblad | 62/434 |
| 4,603,559 | * | 8/1986 | Wu | 62/434 |
| 5,212,958 | * | 5/1993 | Anderson | 62/150 |
| 5,685,165 | * | 11/1997 | Bigelow, Jr. | 62/420 |
| 5,901,563 | * | 5/1999 | Yarbrough et al. | 62/238.7 |
| 5,901,565 | * | 5/1999 | Morton, Jr. | 62/285 |
| 6,044,903 | * | 4/2000 | Heilman et al. | 165/263 |

* cited by examiner

*Primary Examiner*—William Doerrler
*Assistant Examiner*—Mark S. Shulman
(74) *Attorney, Agent, or Firm*—Pitney, Hardin, Kipp & Szuch LLP

(57) ABSTRACT

An air conditioning apparatus includes a case body, and an air cooling coil disposed in the case body to cool an air stream flowing thereacross. A blower is disposed in the case body, and is driven by an output shaft of a motor to blow the air stream across the air cooling coil and deliver cooled air stream forwardly and outwardly of the case body. A drain pane is disposed under the air cooling coil to collect droplets of condensate, and has a first outlet to drain water therein. A water pump includes a pump body with an accommodation chamber, and an impeller received in the chamber and provided with a driven shaft. The driven shaft extends outwardly of the pump body to form a coupling end to be coupled with the output shaft so as to enable the motor to drive the impeller to rotate. The pump body has a second inlet in fluid communication with the first outlet of the drain pane, and a second outlet so that rotation of the impeller will generate a suction force to drain the water from the first outlet via the second inlet and out of the second outlet.

6 Claims, 6 Drawing Sheets

AIR CONDITIONING APPARATUS WITH A WATER PUMP

BACKGROUND OF THE INVENTION

1. Field of the Invention

This invention relates to an air conditioning apparatus, more particularly to an air conditioning apparatus with a water pump disposed therein and driven by a motor of a blower.

2. Description of the Related Art

A conventional air conditioning apparatus generally has a drain pane disposed in a bottom of a case body thereof for collecting droplets of condensate resulting from the cooling of air stream, and a drain pipe fluidly communicated with an outlet of the drain pane and extending outwardly of the case body for draining water outwardly of the air conditioning apparatus. In this manner, it is difficult to drain the water collected in the drain pane completely. To solve this problem, it has been heretofore proposed to connect a water pump to the air conditioning apparatus. However, the water pump needs to be driven by an additional motor, thereby resulting in an increase in the manufacturing cost. In addition, the water pump is disposed outwardly of the air conditioning apparatus, and affects the outer appearance of the apparatus.

SUMMARY OF THE INVENTION

The object of the present invention is to provide an air conditioning apparatus which includes a water pump disposed therein and driven by a motor of a blower to obviate the need for an additional motor mechanism that can affect the outer appearance of the apparatus.

According to this invention, the air conditioning apparatus includes a case body with a chamber therein, and a front panel defining an opening to communicate with the chamber. An air cooling coil is disposed in the chamber and rearwardly of the front panel, and is adapted to cool an air stream flowing thereacross. A blower is disposed in the chamber and rearwardly of the air cooling coil, end is driven by an output shaft of a motor to blow the air stream across the air cooling coil and deliver cooled air stream forwardly and outwardly of the opening. A drain pane is disposed in the chamber and under the air cooling coil to collect droplets of condensate resulting from cooling of the air stream. The drain pane has a first outlet to drain water therein resulting from collection of the droplets. A water pump includes a pump body with an accommodation chamber, and an impeller which is received in the accommodating chamber, and which is provided with a driven shaft rotatably mounted in the accommodation chamber. The driven shaft extends outwardly of the pump body to form a coupling end which is disposed to be coupled with the output shaft of the motor so as to enable the drive of the motor to drive the impeller to rotate. The water pump has a second inlet which is communicated with the accommodation chamber and upstream of the impeller, and which is in fluid communication with the first outlet of the drain pane, and a second outlet which is communicated with the accommodation chamber and downstream of the impeller so that rotation of the impeller will generate a suction force to drain the water from the first outlet via the second inlet and out of the second outlet.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
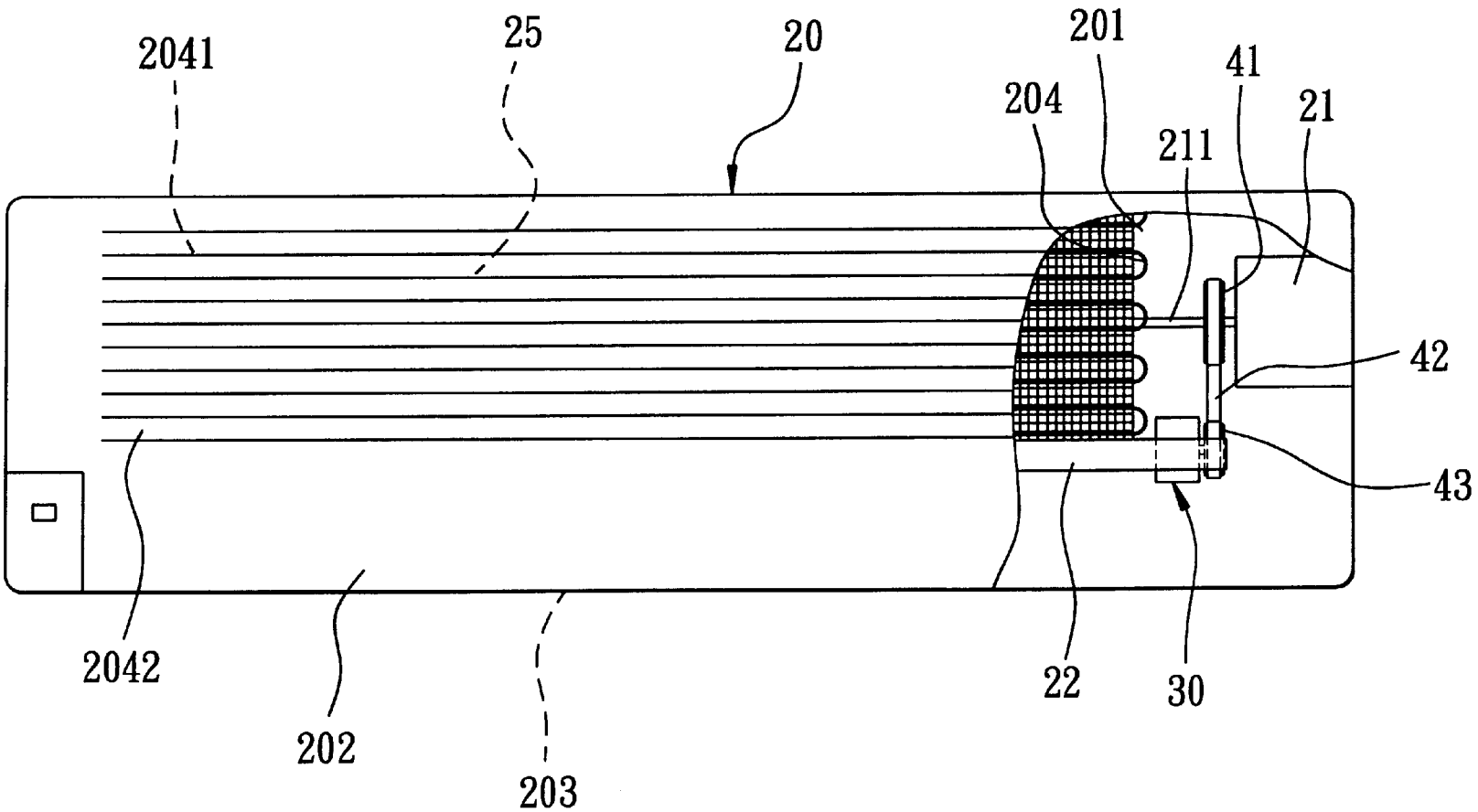
FIG. 1 is a schematic view of a preferred embodiment of an air conditioning apparatus according to this invention.
Figure 4:
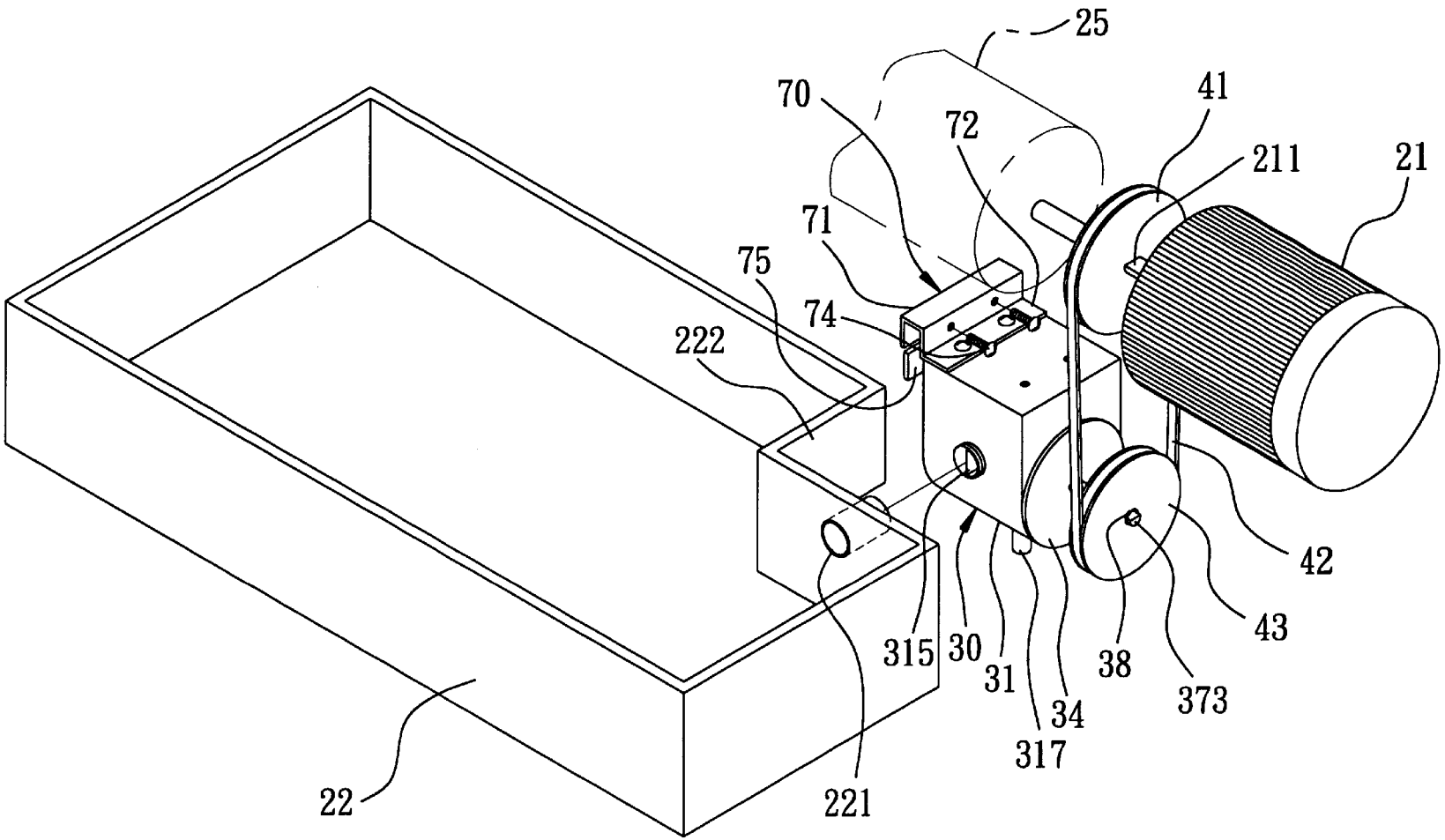
FIG. 4 is a perspective view of a portion of the preferred embodiment.
Figure 6:
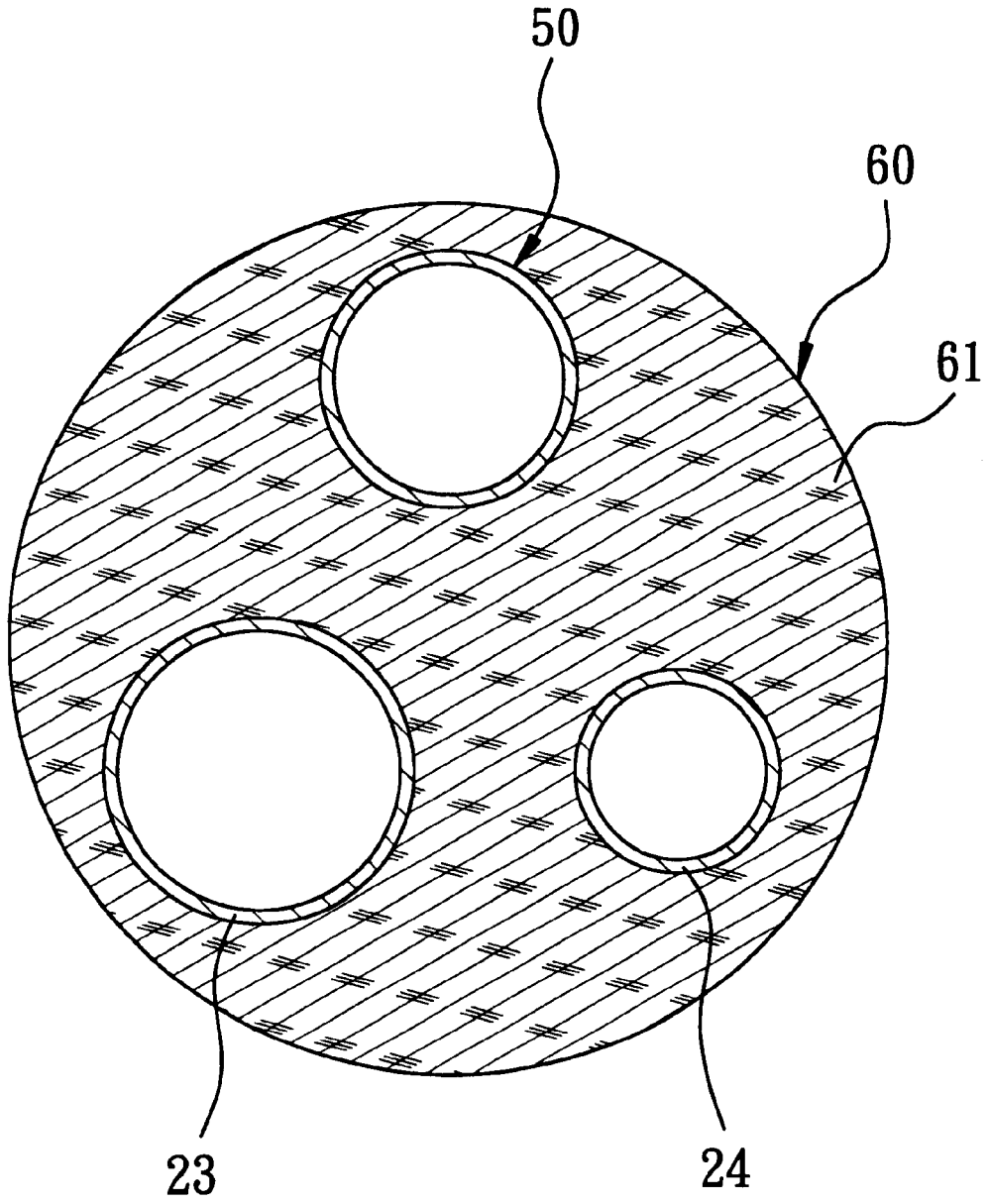
FIG. 6 is a cross-sectional view of the preferred embodiment, taken along lines 6—6 in FIG. 5.

Referring to FIG. 1, the preferred embodiment of the air conditioning apparatus according to the present invention is shown to comprise a case body 20 which has a chamber 201 therein and a front panel 202 defining an opening 203 to communicate with the chamber 201. An air cooling coil 204 is disposed in the chamber 201 and rearwardly of the front panel 202, and is adapted to cool an air stream flowing thereacross. The air cooling coil 204 has a third inlet 2041 and a third outlet 2042 which are respectively disposed to admit flow of a fluid refrigerant in and out of the air cooling coil 204. Supplying and returning pipes 24,23 (see FIG. 6) are in fluid communication with the third inlet 2041 and the third outlet 2042 respectively, and are adapted to communicate with a fourth outlet and a fourth inlet of a condenser coil (not shown) respectively so as to circulate the fluid refrigerant between the air cooling coil 204 and the condenser coil. With reference to FIG. 4, a blower 25 is driven by an output shaft 211 of a motor 21, and is disposed in the chamber 201 and rearwardly of the air cooling coil 204 to blow the air stream across the air cooling coil 204 and deliver cooled air stream forwardly and outwardly of the opening 203. A drain pane 22 is disposed in the chamber 201 and under the air cooling coil 204 to collect droplets of condensate resulting from cooling of the air stream. The drain pane 22 has a first outlet 221 to drain water therein resulting from collection of the droplets.

Figure 2:
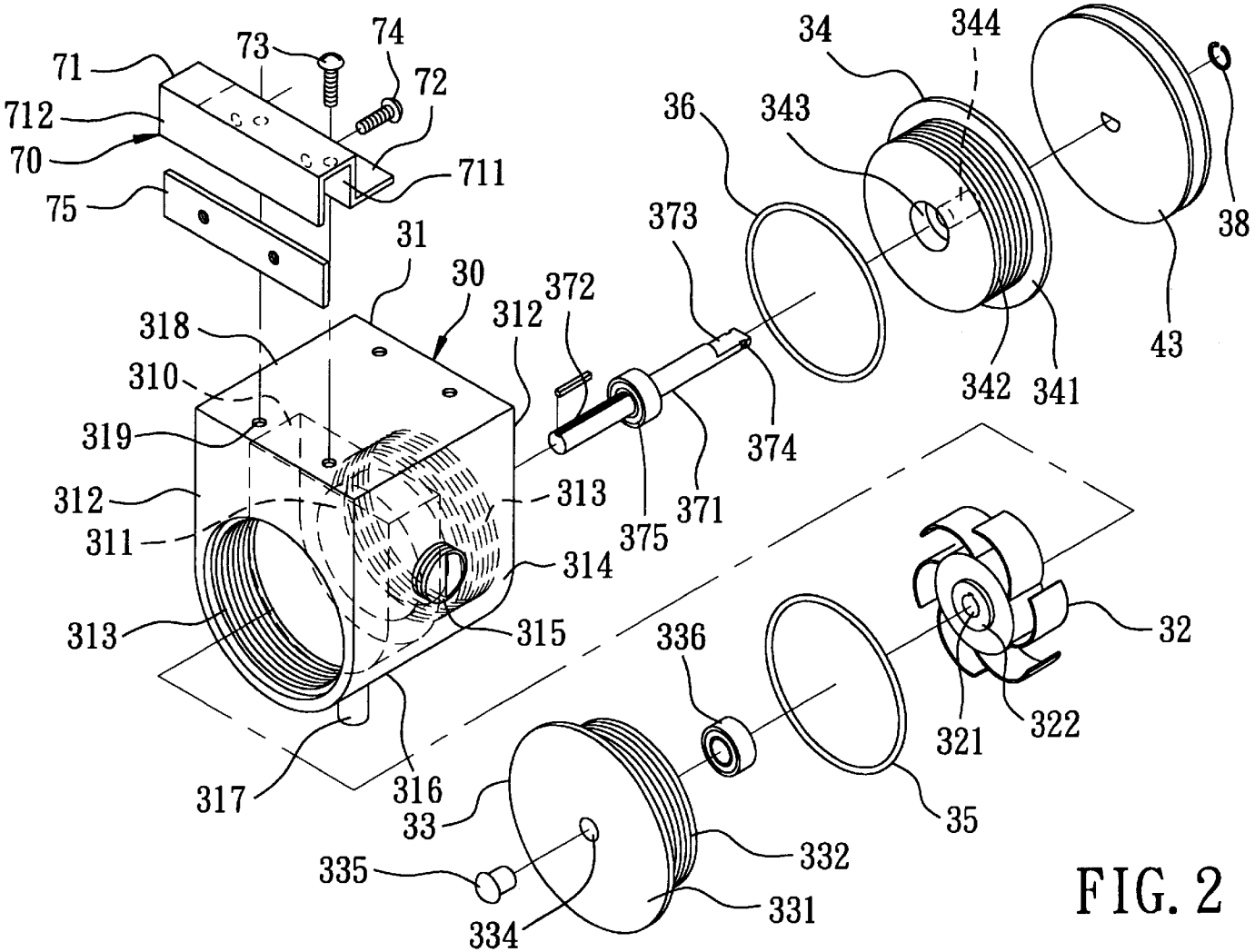
FIG. 2 is an exploded perspective view of a water pump of the air conditioning apparatus of the preferred embodiment.
Figure 3:
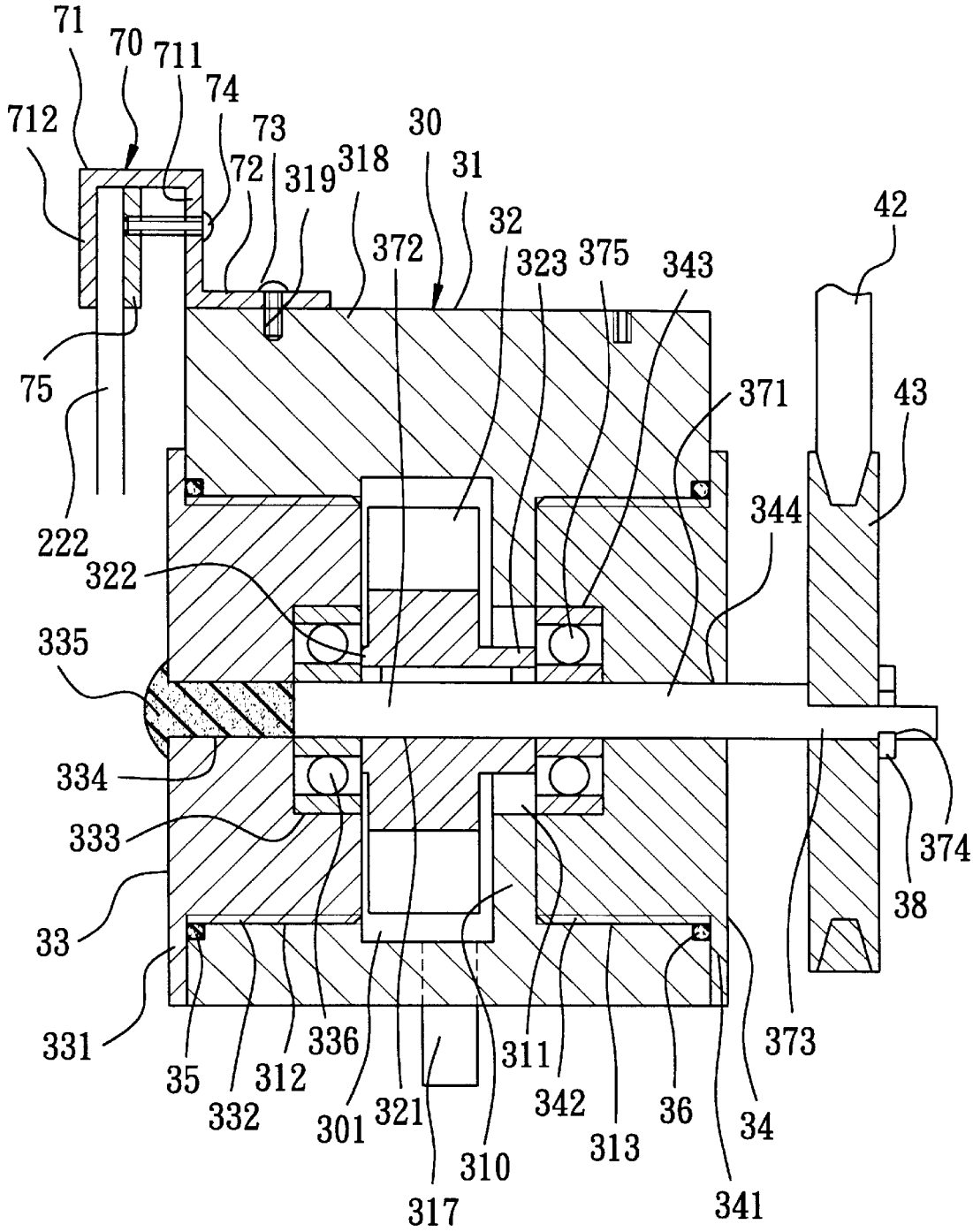
FIG. 3 is a sectional view of the water pump in FIG. 2.

The air conditioning apparatus further includes a water pump 30. With reference to FIGS. 2 and 3, the water pump 30 includes a pump body 31 with an accommodation chamber 301. A partition wall 310 is disposed in the accommodation chamber 301 to partition the chamber 301 into right and left portions, and has a through hole 311 therein to communicate the right and left portions. Right and left side walls 312 are disposed to be spaced apart from each other, and respectively have threaded holes 313 communicated with the chamber 301. Upper and lower side walls 318,316 are disposed on upper and lower ends of the right and left side walls 312 to form the accommodating chamber 301. A second inlet 315 and a second outlet 317 are respectively disposed in a front side wall 314 and the lower side wall 316, and are in communication with the chamber 301. Referring to FIG. 4, the second inlet 315 is in fluid communication with the first outlet 221 in the drain pane 22. In addition, a heat reserving material (not shown, such as polyethylene) may be disposed on the pump body 31 so as to prevent condensing outside the pump body 31.

An impeller 32 is received in the chamber 301, and is formed with a central hole 321, and right and left protrusions 323,322. A driven shaft 371 includes a right end portion 373 which extends outwardly of the pump body 31 to form a coupling end with an annular groove 374 formed therein, and a left end portion 372 which is secured to and which extends through the central hole 321 of the impeller 32.

Right and left covering members 34, 33 respectively have covering portions 341,331, and threaded portions 342,332 which engage threadedly and which cover the threaded holes 313 of the right and left side walls 312. The threaded portions 342,332 respectively have mounting recesses 343, 333 for receiving right and left bearings 375,336 which engage the driven shaft 371 for accommodating the rotation of the driven shaft 371, and through holes 344,334 for insertion of a plug 335 and the right end portion 373 of the driven shaft 371. As such, when the threaded portions 342, 332 are brought to engage threadedly the threaded holes 313, the protrusions 323,322 on the impeller 32 will abut against the bearings 375,336 to retain the same in the recesses 343,333. Two O-rings 36,35 are sleeved on the threaded portions 342,332 for providing a water-tight seal between the threaded holes 313 and the threaded portions 342,332.

Figure 5:
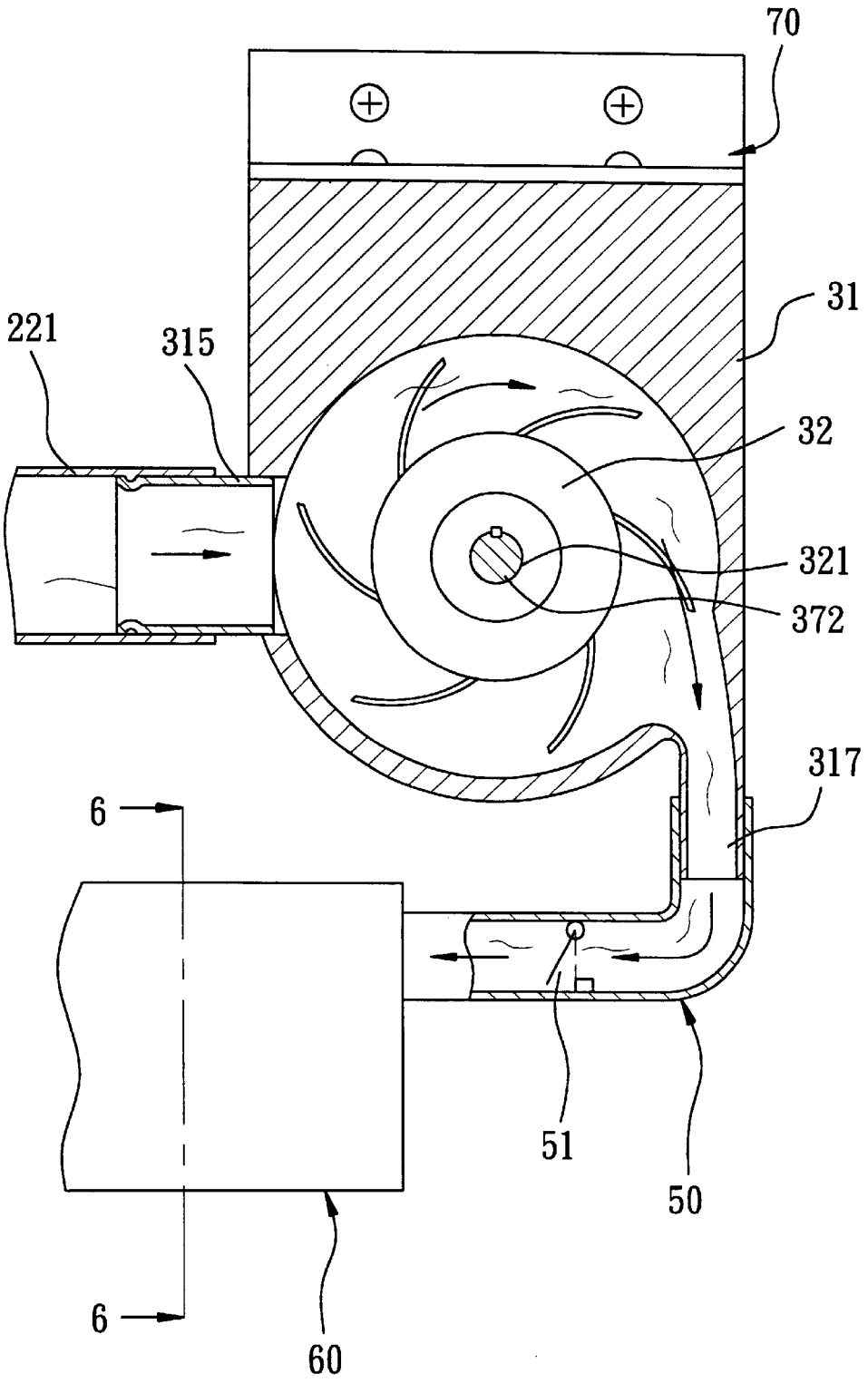
FIG. 5 is a sectional view showing the portion of the preferred embodiment in a state of use.

Referring to FIGS. 3 and 4, a rotary wheel 43 is sleeved on and is secured to the coupling end of the driven shaft 371 via a C-shaped clamp 38 that is disposed in the annular groove 374. A transmitting band 42 is trained on the rotary wheel 43 and a driving wheel 41 which is connected to the output shaft 211 of the motor 21. In this structure, the driving wheel 41 is rotated by the motor 21, and drives the rotary wheel 43 to rotate the driven shaft 371, thereby actuating the rotation of the impeller 32. With reference to FIG. 5, the rotation of the impeller 32 will generate a suction force to drain the water from the first outlet 221 via the second inlet 315 and out of the second outlet 317. Moreover, a drain pipe 50 is fluidly communicated with the second outlet 317, and is disposed to extend axial to and along with the supplying and returning pipes 24,23 (see FIG. 6) in a unified core structure 60 in such a manner that a heat reserving material 61 is filled there among. In addition, a check valve 51 is received in the drain pipe 50 for allowing only the water from the second outlet 317 to flow outwardly.

In view of the aforementioned structure, the impeller 32 of the water pump 30 is rotated by driving of the motor 21 which drives the blower 25 without the need for an additional driving mechanism, thereby resulting in a reduction in the manufacturing cost. In addition, the water pump 30 is received in the chamber 201 of the case body 20 without affecting the outer appearance of the air conditioning apparatus. Moreover, since the drain pipe 50 is disposed along with the supplying and returning pipes in the unified core structure 60, the assembly is convenient to conduct, and the water flowing therein can return back to cool the condenser coil so as to enhance the cooling effect.

Referring again to FIGS. 2, 3 and 4, to secure the pump body 31 on the drain pane 22 which may have a variety of dimensions, a fastening member 70 is provided and includes a connecting portion 72 and an anchoring portion 71 formed integrally with the connecting portion 72. The connecting portion 72 is secured on the upper side wall 318 in such a manner that screw fasteners 73 pass therethrough and engage threadedly screw holes 319 of the upper side wall 318. The anchoring portion 71 includes inner and outer walls 711,712, and is mounted on a side wall 222 of the drain pane 22 in such a manner that screw fasteners 74 pass through the inner wall 711 and engage threadedly a lock plate 75 which is disposed between the inner and outer walls 711,712 so as to sandwich tightly the side wall 222 between the lock plate 75 and the outer wall 712.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. An air conditioning apparatus comprising:

a case body having a chamber therein, and a front panel defining an opening to communicate with said chamber;

an air cooling coil disposed in said chamber and rearwardly of said front panel, and adapted to cool an air stream flowing thereacross;

a blower disposed in said chamber and rearwardly of said air cooling coil to blow the air stream across said air cooling coil and deliver cooled air stream forwardly and outwardly of said opening;

a motor with an output shaft to drive said blower;

a drain pane disposed in said chamber and under said air cooling coil to collect droplets of condensate resulting from cooling of the air stream, said drain pane having a first outlet to drain water therein resulting from collection of the droplets; and a water pump including a pump body having an accommodation chamber, an impeller received in said accommodation chamber, and provided with a driven shaft rotatably mounted in said accommodation chamber and extending outwardly of said pump body to form a coupling end disposed to be coupled with said output shaft so as to enable said output shaft to drive said impeller to rotate, a second inlet disposed to be in communication with said accommodation chamber and upstream of said impeller, said second inlet being in fluid communication with said first outlet, and a second outlet disposed to be in communication with said accommodation chamber and downstream of said impeller so that rotation of said impeller will generate a suction force to drain the water from said first outlet via said second inlet and out of said second outlet.

2. The air conditioning apparatus as claimed in claim 1, wherein said air cooling coil has a third inlet and a third outlet respectively disposed to admit flow of a fluid refrigerant in and out of said air cooling coil, said apparatus further comprising supplying and returning pipes which are in fluid communication with said third inlet and said third outlet respectively and which are adapted to communicate with a fourth outlet and a fourth inlet of a condenser coil respectively so as to circulate the fluid refrigerant between said air cooling coil and the condenser coil, and a drain pipe which is fluidly communicated with said second outlet, and which is disposed to extend axial to and along with said supplying and returning pipes in a unified core structure.

3. The air conditioning apparatus as claimed in claim 2, further comprising a check valve received in said drain pipe for allowing only the water from said second outlet to flow outwardly.

4. The air conditioning apparatus as claimed in claim 1, wherein said pump body includes right and left side walls spaced apart from each other to form said accommodation chamber therein, said driven shaft having a left end portion disposed in said left side wall and a right end portion extending outwardly of said right side wall to form said coupling end.

5. The air conditioning apparatus as claimed in claim 4, wherein said water pump further includes right and left bearings respectively mounted in said right and left side walls and engaging said driven shaft for accommodating the rotation of said driven shaft.

6. The air conditioning apparatus as claimed in claim 5, wherein each of said right and left side walls has a threaded hole communicated with said accommodation chamber, said pump body further including right and left covering members, each provided with a threaded portion engaging threadedly and covering said threaded hole of a respective one of said right and left side walls.

* * * * *